United States Patent [19]

Gravener

[11] 3,987,539

[45] Oct. 26, 1976

[54] METHOD OF MAKING A MOLDED COMMUTATOR

[75] Inventor: Roy Dennison Gravener, Bethany, Conn.

[73] Assignee: Consolidated Foods Corporation, Old Greenwich, Conn.

[22] Filed: Jan. 31, 1974

[21] Appl. No.: 438,186

[52] U.S. Cl. ..... 29/597; 72/370; 72/392

[51] Int. Cl.[2] ..... H01R 43/08

[58] Field of Search ..... 29/597; 310/235, 236; 264/274; 72/370, 392

[56] References Cited

UNITED STATES PATENTS

| | | | |
|---|---|---|---|
| 1,875,204 | 8/1932 | Apple | 29/597 |
| 2,188,423 | 1/1940 | Andrews | 29/597 |
| 2,320,541 | 6/1943 | Wilson | 29/597 |
| 3,140,414 | 7/1964 | Skjodt et al. | 29/597 |
| 3,468,020 | 9/1969 | Carlson et al. | 29/597 |
| 3,566,460 | 3/1971 | Yamaguchi | 29/597 |

*Primary Examiner*—Carl E. Hall
*Attorney, Agent, or Firm*—William S. Henry

[57] ABSTRACT

In accordance with the present invention there is provided a molded commutator having an improved form of anchoring tooth for each bar extending substantially the entire length of the bar for securing the latter to the molded hub. The invention involves an improved process of forming each anchoring tooth without the removal of any material and hence without wastage.

4 Claims, 22 Drawing Figures

METHOD OF MAKING A MOLDED COMMUTATOR

BACKGROUND OF THE INVENTION

Heretofore, numerous arrangements have been employed for anchoring commutator bars into a molded hub, such as the provision of various shapes of hooks and other projections extending from the bars into the hub. Particularly in modern high speed universal motors these bars are subjected to very high centrifugal forces tending to pull them away from the hub and even a slight shifting of one or more bars has an adverse effect on commutation and previous arrangements have given much trouble. Also, in many cases the formation of the anchoring projections has involved the removal, and hence waste, of the comparatively expensive copper of which the bars are almost universally made.

SUMMARY OF THE INVENTION

In accordance with this invention, a tube, usually of copper, of a length convenient to handle is formed with a number of lengthwise extending internal teeth having rectangular profiles, the number being equal to the number of bars desired in the finished commutator. Such a tube may be formed by known methods of extruding, drawing or cold forming. A mandrel is provided having on its outer surface a like number of forming surfaces which change progressively from a sharp profile at the front or leading end of the mandrel to a substantially flat profile at the rear or trailing end. This mandrel is passed through the tube with the forming surfaces in line with the teeth with the result that each tooth is progressively changed from its original rectangular profile to a form which is substantially T-shaped in a cross-section. The tube is cut into sections, each of suitable length for a commutator. Each section is counter bored at one end to eventually provide tangs for connecting electric leads to the commutator bars. Thereafter, each section together with a bushing is placed in a mold and molding material, such as phenolic resin, is forced into the mold under heat and pressure in the usual manner. After the material has hardened, the tube is slit lengthwise between the anchoring teeth to form the individual commutator bars and cuts are made in the counterbored end to form the tangs.

Figure 1:
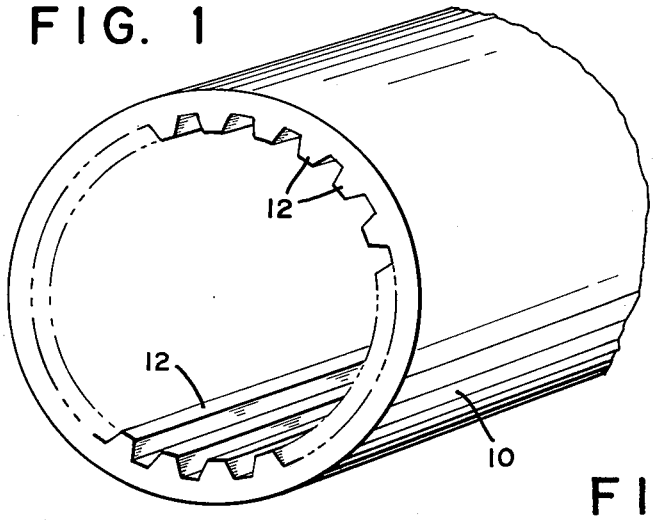
FIG. 1 is a prospective view of a tube formed with internal teeth having a rectangular profile.

Referring to the drawings, reference character 10 designates a tube, preferably of copper, formed with a series of interior flat ended teeth or ridges 12 having a rectangular profile extending lengthwise thereof, the number of teeth corresponding to the desired number of bars in the finished commutator. Tube 10 with teeth 12 may be made by any one of several known methods, such as extruding, drawing or cold forming. Tube 10 may be of any length convenient to handle, but normally will be several times the length of a finished commutator.

Figure 13:
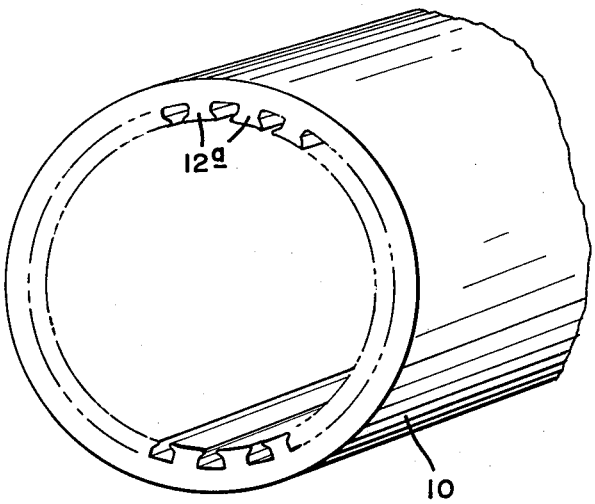
FIG. 13 is a view similar to FIG. 1, but showing the tube after the mandrel has been passed therethrough.
Figure 2:
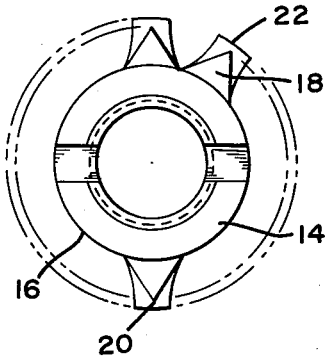
FIG. 2 is an end view of a mandrel.
Figure 3:
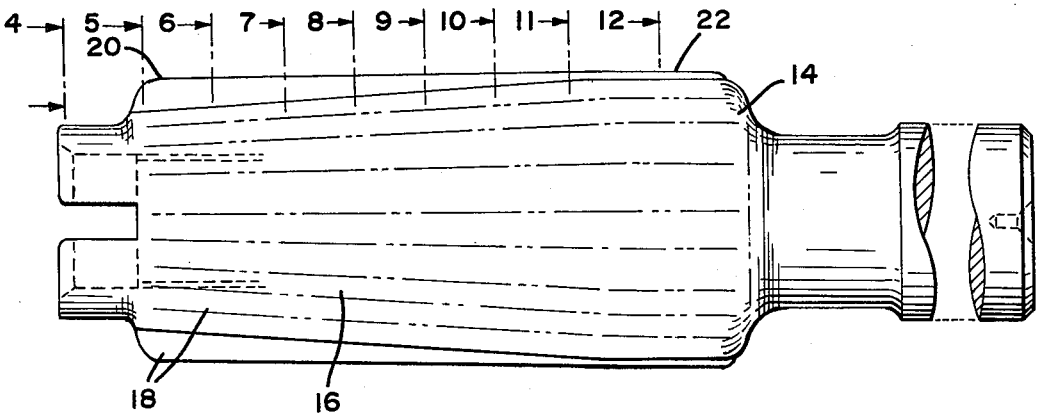
FIG. 3 is a side view of the mandrel shown in FIG. 2.

In FIGS. 2 and 3, there is shown a mandrel 14 which is passed axially through tube 10 for the purpose of altering the shape of teeth 12 from that shown in FIG. 1 to the substantially T-shape of teeth 12*a* in FIG. 13. This mandrel comprises a slightly conical body 16 formed with a plurality of external teeth 18 the cross-sectional configuration of each tooth changing gradually along the length of the mandrel. At the left end, as viewed in FIG. 3, which is the leading end as the mandrel is moved through the tube, the teeth are sharply pointed, as is indicated at 20 while at the right or trailing end they are smoothly rounded, as shown at 22.

Figure 4:
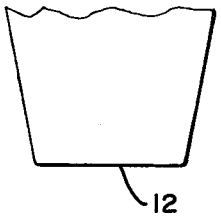
FIG. 4 is an end view of an enlarged scale one of the teeth shown in FIG. 1.
Figure 5:
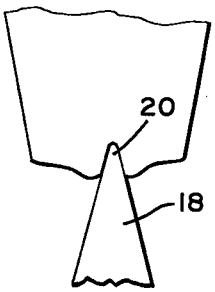
FIGS. 5 through 12 are end views of the tooth as its shape is changed by the movement of the mandrel through the tube, each showing the shape of the tooth resulting from the action of the point on the mandrel designated by the correspondingly numbered broken line in FIG. 3.
Figure 6:
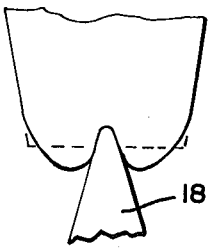
Figure 7:
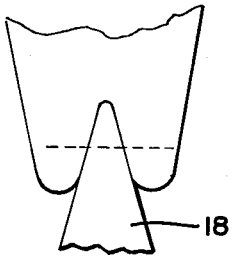
Figure 8:
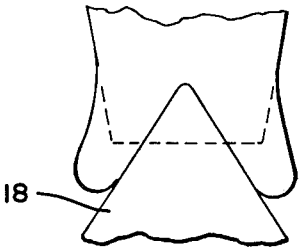
Figure 9:
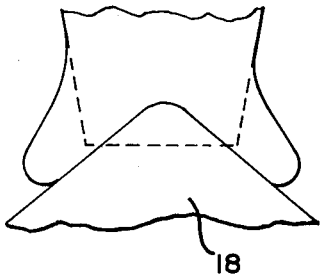
Figure 10:
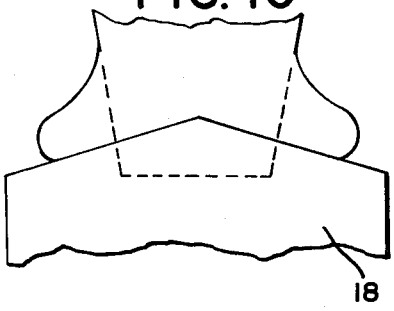
Figure 11:
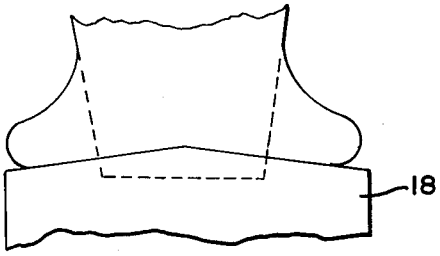

When the mandrel is passed through the tube 10 with the teeth 18 of the mandrel aligned with the teeth 12 of the tube, the cross-sectional configuration of each tooth is progressively changed as is illustrated FIGS. FIG. 4 through 12. In FIG. 4 the tooth 12 is shown in its original shape before it has been acted on by the tooth 18, while in FIG. 5 sharply pointed end 20 of tooth 18 has started to deform tooth 12.

Figure 12:
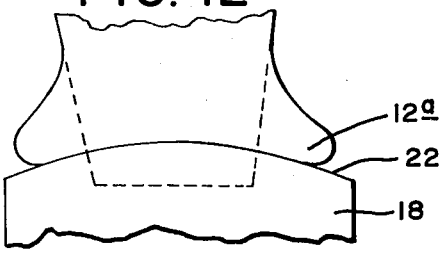

The change in shape progresses in the manner shown in FIGS. 6 through 12 as the mandrel is moved through the tube, the cross-section of the teeth in tube 10 finally being substantially T-shaped as illustrated at 12*a* in FIGS. 12 and 13.

Figure 14:
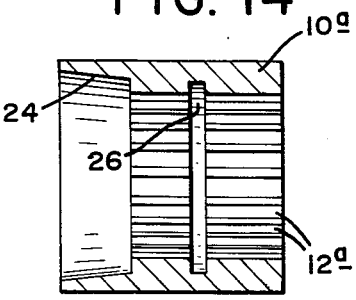
FIG. 14 is a cross-sectional view of a short section of tube cut from the tube of FIG. 13 and counterbored.

If the tube 10 is longer than a single commutator, as is normally the case, it is now cut into a plurality of short tubes as indicated at 10*a* in FIG. 14. One end of each tube 10*a* is counterbored as shown at 24 and an interior annular groove 26 is formed therein.

Figure 15:
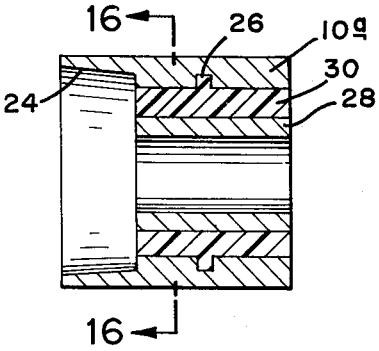
FIG. 15 is a cross-sectional view of the tube section shown in FIG. 14 after it has been molded on a bushing.
Figure 16:
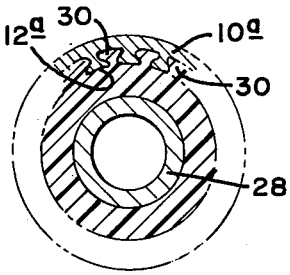
FIG. 16 is a cross-sectional view taken on the line 16—16 of FIG. 15.

The tube 10*a* and a metal bushing 28 having a preferably knurled outer surface are then placed concentrically in a plastic molding machine and plastic such as phenol resin is forced between tube 10*a* and the bushing under heat and pressure and permitted to harden, as is indicated at 30 in FIGS. 15 and 16. As will be seen particularly in the cross-sectional view of FIG. 16, the T-shaped teeth 12*a* are firmly embedded and anchored in the plastic 30 while the plastic filling the annular groove 26 prevents axial movement of the tube 10*a*. The knurled outer surface of bushing 28 assures a firm bond between the plastic and the bushing.

Figure 17:
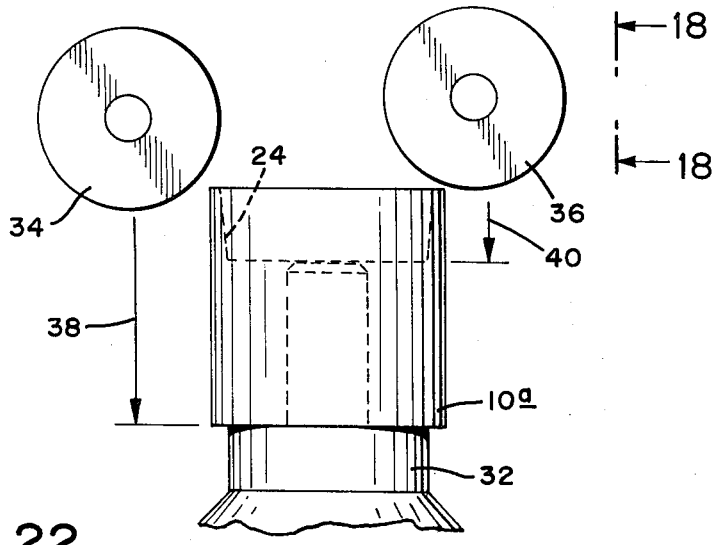
FIG. 17 is an elevational view of the cutters employed to form the tangs and separate the tube into commutator bars.
Figure 18:
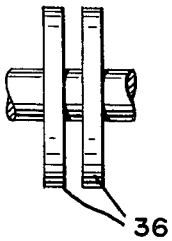
FIG. 18 is a view looking in the direction of the arrows 18—18 in FIG. 17 of the double cutter employed to form the tangs.
Figure 19:
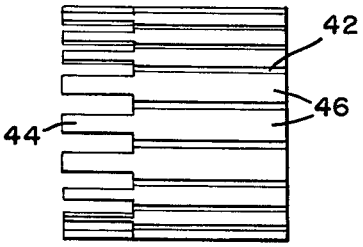
FIG. 19 is an elevational view of the tube section after slotting and formation of the tangs, and which comprises the completed commutator.
Figure 20:
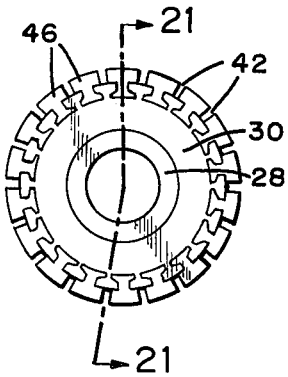
FIG. 20 is an end view of the commutator illustrated in FIG. 19.
Figure 21:
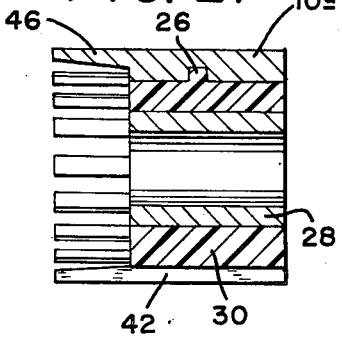
FIG. 21 is a cross-sectional view taken on the line 21—21 of FIG. 20.

After the molding operation, the assemblage of FIGS. 15 and 16 is placed on a work holder 32 of a machine tool, shown schematically in FIGS. 17 and 18. The tool has a single rotary cutter 34 and a pair of cutters 36. These cutters are mounted for reciprocating vertical movement in the direction and length of stroke indicated by the arrows 38 and 40, respectively. The tube 10*a* is placed on the holder 32 so that the single cutter 34 is aligned exactly with the center of the space between an adjacent pair of teeth 12*a*, while the pair of cutters 36 is aligned so that each cutter of the pair is equal distantly spaced on either side of the center of the space between an adjacent pair of teeth on the opposite side of tube 10*a*. The cutter 34 and 36 are moved downwardly, preferably at the same time, but in any event while the assembledge remains fixed on the work holder 32. The single cutter 34 moving through the stroke 38 forms a slot 42, FIGS. 19, 20 and 22, extending the entire length of tube 10*a*. Cutters 36, on the other hand, moving through the shorter stroke 40 which extends only to the inner end of undercut 24, removes material so as to form a tang 44. After the cutters have been retracted, work holder 32 with the assembladge still fixed thereto is turned or indexed so as to align the center of the next space between teeth 12*a* with cutter 34. This is repeated until slots 42 have been cut between each of the teeth 12*a* the hub form individual commutator bars 46, each with a tang 44 extending from one end. Because the slots and the tangs are formed without removing the tube 10*a* from holder 32, it is assured that they are in proper relationship to each other, that is each tang 44 is perfectly centered between slots 42 and hence is centered with respect to bar 46.

The purpose of tangs 44 is to provide locations for attaching armature leads to the individual commutator bars 46 and particularly in an automated motor assembly line it is essential that the tangs be accurately located with respect to the bars and this is assured by the fact that all cuts are made without removing the tube 10*a* from the work holder 32.

Due to the fact that each bar 10*a* has formed integral therewith the substantially T-shaped tooth 12*a*, which extends the entire length of the bar, embedded and anchored in the plastic hub 30, the bar is able to withstand high centrifugal forces resulting from high speed rotation of the commutator, thus preventing any shifting of the bars relative to thehub and to each other.

Figure 22:
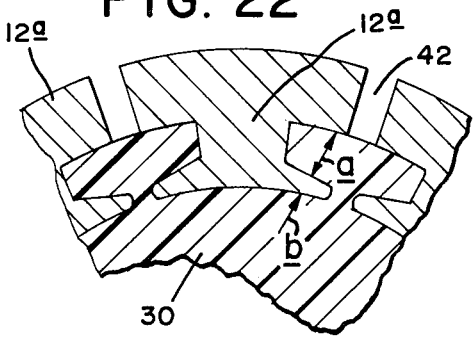
FIG. 22 is an enlarged cross-sectional view of a portion of the commutator shown in FIG. 16.

As is shown in FIG. 22, the dimensions *a* through the plastic 30 and *b* through the copper, where the maximum strain produced by centrifugal force acting on the bar 12*a* occurs, should be in the inverse ratio to the strengths of the respective materials. That is, if the copper has three times the strength of the plastic, the dimension *a* through the plastic should be three times the dimension *b* through the copper, and this relationship is readily obtainable by the T-shaped bar 12*a*.

While I have shown and described a preferred embodiment of my invention, it will be understood that this has been done for purposes of illustration only, and that the scope of my invention is not to be limited thereby, but is to be determined by the appended claims.

I claim:

1. That improvement in the method of producing electric motor commutators which comprises forming a tube with a plurality of internal longitudinal teeth having rectangular profiles, passing longitudinally through said tube a mandrel formed with external teeth having profiles changing progressively along the length of the mandrel from pointed at the leading end to rounded at the trailing end to progressively displace metal from the centers of the teeth to the opposite sides thereof to change the rectangular profile of said internal teeth to a profile which is substantially T-shaped in cross-section, locating a bushing of smaller diameter than said tube concentrically within the latter, filling the annular space between said bushing and said tube with plastic molding material to form a hub with said T-shaped teeth embedded and anchored in said material, and slotting said tube longitudinally between said T-shaped teeth to form individual commutator bars.

2. The method as set forth in claim 1 which comprises selecting a tube the original length of which is several times that of the finished commutator and cutting said tube into a plurality of commutator - length sections following the formation of said T-shaped internal teeth.

3. The method as set forth in claim 1 which comprises undercutting one end of said tube following the formation of said T-shaped internal teeth, and, at the same time the tube is slit longitudinally to form bars, cutting said end of the tube to form a tang extending from each bar.

4. The method as set forth in claim 3 in which the slotting of said tube and the formation of the tangs is accomplished by supporting said hub on the work holder of a rotary cutter fitted with cutter means for slotting the tube and cutter means for removing metal from said undercut end of the tube to form tangs, and maintaining said hub fixed on said work holder while operating both of said cutter means to thereby assure that the respective cuts are accurately located with respect to each other to in turn assure that each tang is properly located with respect to each bar.

* * * * *